US011064290B2

(12) United States Patent
Son et al.

(10) Patent No.: US 11,064,290 B2
(45) Date of Patent: Jul. 13, 2021

(54) SPEAKER APPARATUS

(71) Applicant: SAMSUNG ELECTRONICS CO., LTD., Suwon-si (KR)

(72) Inventors: Sung-Ha Son, Suwon-si (KR); Jong Bae Kim, Seoul (KR); Sung Joo Kim, Suwon-si (KR); Gyeong-Tae Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/754,967

(22) PCT Filed: Sep. 4, 2018

(86) PCT No.: PCT/KR2018/010263

§ 371 (c)(1),
(2) Date: Apr. 9, 2020

(87) PCT Pub. No.: WO2019/074207

PCT Pub. Date: Apr. 18, 2019

(65) Prior Publication Data

US 2020/0245062 A1 Jul. 30, 2020

(30) Foreign Application Priority Data

Oct. 11, 2017 (KR) ..... 10-2017-0129831

(51) Int. Cl.
*H04R 1/34* (2006.01)

(52) U.S. Cl.
CPC ..... *H04R 1/345* (2013.01)

(58) Field of Classification Search
CPC ..... H04R 1/345
(Continued)

(56) References Cited

U.S. PATENT DOCUMENTS 4,313,032 A * 1/1982 Thomas ..... H04R 1/30 181/152
4,790,408 A * 12/1988 Adair ..... H04R 1/26 181/144

(Continued)

FOREIGN PATENT DOCUMENTS

JP 2010-245630 10/2010
KR 10-2010-0007674 1/2010

(Continued)

OTHER PUBLICATIONS

International Search Report for PCT/KR2018/010263, dated Jan. 4, 2019, 5 pages.

(Continued)

*Primary Examiner* — Sean H Nguyen
(74) *Attorney, Agent, or Firm* — Nixon & Vanderhye, P.C.

(57) ABSTRACT

Disclosed herein is a slit-firing speaker apparatus capable of full frequency band reproduction. The speaker apparatus includes a speaker unit configured to generate sound, an enclosure, in which the speaker unit is installed, configured to block rearward sound to prevent the rearward sound of the speaker unit from being mixed with forward sound of the speaker unit, and a reflection plate configured to cover the speaker unit and coupled to the enclosure to form an acoustic path through which the generated sound travels. The acoustic path includes a radiation part formed at one end of the acoustic path and radiating the generated sound, and an opening part formed at the other end of the acoustic path.

11 Claims, 12 Drawing Sheets

(58) Field of Classification Search
USPC ..... 381/352
See application file for complete search history.

(56) References Cited

U.S. PATENT DOCUMENTS

| | | | | | |
|---|---|---|---|---|---|
| 4,979,219 | A * | 12/1990 | Lin | H04R 17/00 | 310/324 |
| 5,943,430 | A * | 8/1999 | Saitoh | H04N 5/642 | 381/160 |
| 6,574,344 | B1 * | 6/2003 | Wiener | H04R 1/345 | 381/343 |
| 9,363,586 | B2 * | 6/2016 | Fincham | H04R 1/288 | |
| 2011/0019855 | A1 * | 1/2011 | Lee | H04R 1/2857 | 381/349 |
| 2014/0369533 | A1 * | 12/2014 | Kim | H04R 1/345 | 381/160 |
| 2016/0192063 | A1 * | 6/2016 | Lee | H04N 5/642 | 381/306 |

FOREIGN PATENT DOCUMENTS

| | | |
|---|---|---|
| KR | 10-2011-0090062 | 8/2011 |
| KR | 10-2015-0008809 | 1/2015 |
| KR | 10-2016-0142384 | 12/2016 |

OTHER PUBLICATIONS

Written Opinion of the ISA for PCT/KR2018/010263, dated Jan. 4, 2019, 4 pages.

* cited by examiner

SPEAKER APPARATUS

This application is the U.S. national phase of International Application No. PCT/KR2018/010263 filed 4 Sep. 2018, which designated the U.S. and claims priority to KR Patent Application No. 10-2017-0129831 filed 11 Oct. 2017, the entire contents of each of which are hereby incorporated by reference.

TECHNICAL FIELD

The disclosure relates to a speaker apparatus, and more specifically, to a slit-firing speaker apparatus.

BACKGROUND ART

In general, a speaker installed in an electronic device is provided in at least one type of front-firing, side-firing, down-firing and back-firing types.

In the back-firing type, a speaker unit is mounted on a rear surface of an electronic device and radiates the sound backward, and the sound is transmitted to the front using diffraction. The back-firing type is usually used for woofers designed to reproduce low frequency sounds. Since the middle and high frequency sounds have short wavelengths and directivity, the acoustic characteristics are significantly degraded when the back-firing type is used.

These days, electronic devices are becoming slimmer and their bezels are also becoming narrower. Since the front-firing type occupies a relatively large area of the front f the electronic device, it is not suitable for today's bezel-less design trends.

In the case of the side-firing type or the down-firing type, it is common that a speaker unit is arranged to face the side or the bottom. With this arrangement, it is necessary to reduce the size of the speaker unit to conform to the slimmed electronic device. The reduction of the size of the speaker unit leads to reduction of a diaphragm area, making it impossible to produce the low frequency sound.

In order to solve this problem, as shown in FIG. 1, a slit-firing speaker has been proposed in which a speaker unit 10 is disposed not toward the side surface or the lower surface of an electronic device 1 but toward the front.

According to the slit-firing speaker, reproduced sound moves along a narrow path in front of the speaker unit and is then radiated through a slit 20 provided in a side direction of the speaker unit. A slit-firing speaker according to the related art has a structure in which only one slit 20 through which the reproduced sound is radiated is included and an opposite surface of the slit 20 is closed structure.

Due to this structure, the acoustic pressure is maximized in the slit and minimized at the closed surface. In addition, due to this acoustic pressure difference, resonance occurs at a frequency at which the width of the speaker unit corresponds to a quarter wavelength, thereby causing a problem with acoustic performance.

For example, as shown in FIG. 2, a large peak and a large dip occur at approximately 2.5 kHz and approximately 5.5 kHz, respectively. The peak may be compensated by equalizer control. By contrast, it is impossible to compensate for the dip, so a separate tweeter is required for high frequency reinforcement, which causes an increase in cost.

SUMMARY

It is an aspect of the disclosure to provide a slit-firing speaker apparatus having improved acoustic performance.

It is another aspect of the disclosure to provide a slit-firing speaker apparatus in which occurrences of peak and dip are enhanced.

It is another aspect of the disclosure to provide a slit-firing speaker apparatus capable of full band reproduction without a separate tweeter unit.

It is another aspect of the disclosure to provide a slit-firing speaker apparatus with reduced manufacturing cost and improved profitability.

In accordance with an aspect of the disclosure, a speaker apparatus includes a speaker unit configured to generate sound, an enclosure, in which the speaker unit is installed, configured to block sound directed rearward to prevent sound directed forward and the sound directed rearward from being mixed, and a reflection plate configured to cover the speaker unit and coupled to the enclosure to form an acoustic path through which the generated sound travels. The acoustic path includes a radiation part formed at an end of the acoustic path and radiating the generated sound and an opening part formed at the other end of the acoustic path.

The radiation part may include a slit-shaped opening having lateral length longer than longitudinal length.

The acoustic path may include a radiation path configured to guide the generated sound to the outside of the speaker apparatus to allow a user to hear the generated sound and a control path provided to regulate generation of resonance in the acoustic path.

The radiation path may extend from the speaker unit to the radiation part, and the control path may extend from the speaker unit to the opening part.

Length of the control path may be formed to be at least twice the length of the radiation path.

The control path may have varying width from an end of the radiation path toward the opening part.

The speaker unit may be disposed at an end in a longitudinal direction of the enclosure to be adjacent to the radiation part.

The reflection plate may include a surface facing the speaker unit, and the surface is provided to correspond to the shape of the speaker unit so that a distance between the surface and the speaker unit is not changed.

The acoustic path may have constant width throughout the acoustic path.

The acoustic path may include a curved portion.

The enclosure may include a duct extending from a hole formed on a surface facing the reflection plate toward an inside of the enclosure.

An acoustic pressure of the sound radiated through the control path may be less than an acoustic pressure of the sound radiated through the radiation path.

The acoustic path may prevent leakage of the sound generated in the speaker unit so that the sound generated by the speaker unit is radiated through the radiation part.

In accordance with an aspect of the disclosure, a speaker apparatus include a speaker unit configured to generate sound, an enclosure, in which the speaker unit is installed, including a pair of blocking walls provided on opposite sides of the speaker unit, a reflection plate disposed between the pair of blocking walls to cover the speaker unit, and an acoustic path formed by the pair of blocking walls, the reflection plate and the enclosure.

The acoustic path may be open at opposite ends, and a distance from the speaker unit to a first end of the acoustic path may be smaller than a distance from the speaker unit to a second end of the acoustic path.

The acoustic path may include a radiation part provided in a slit shape at the first end of the acoustic path and configured to radiate the generated sound.

The acoustic path may include a radiation path configured to guide the generated sound to the outside of the speaker apparatus to allow a user to hear the generated sound, and a control path provided to regulate generation of resonance in the acoustic path.

The radiation path may extend from the speaker unit to the first end of the acoustic path.

The control path may extend from the speaker unit to the second end of the acoustic path and the first end of the acoustic path may be adjacent to the speaker unit.

The pair of blocking walls and the reflection plate may prevent leakage of sound such that the sound generated in the speaker unit is emitted only through the first end and the second end of the acoustic path.

An acoustic pressure of the sound emitted through the control path may be less than an acoustic pressure of the sound emitted through the radiation path.

The control path may have varying width from an end of the radiation path to the other open end of the acoustic path.

According to embodiments of the disclosure, a slit-firing speaker apparatus with improved acoustic performance may be provided.

According to embodiments of the disclosure, a slit-firing speaker apparatus in which peak and dip are improved may be provided.

According to embodiments of the disclosure, a slit-firing speaker apparatus capable of entire frequency band reproduction without a separate tweeter unit may be provided.

According to embodiments of the disclosure, a slit-firing speaker apparatus in which profitability is improved by reducing manufacturing cost may be provided.

DETAILED DESCRIPTION OF EXAMPLE EMBODIMENTS

Various embodiments of the disclosure will now be described with reference to the accompanying drawings.

Figure 3:
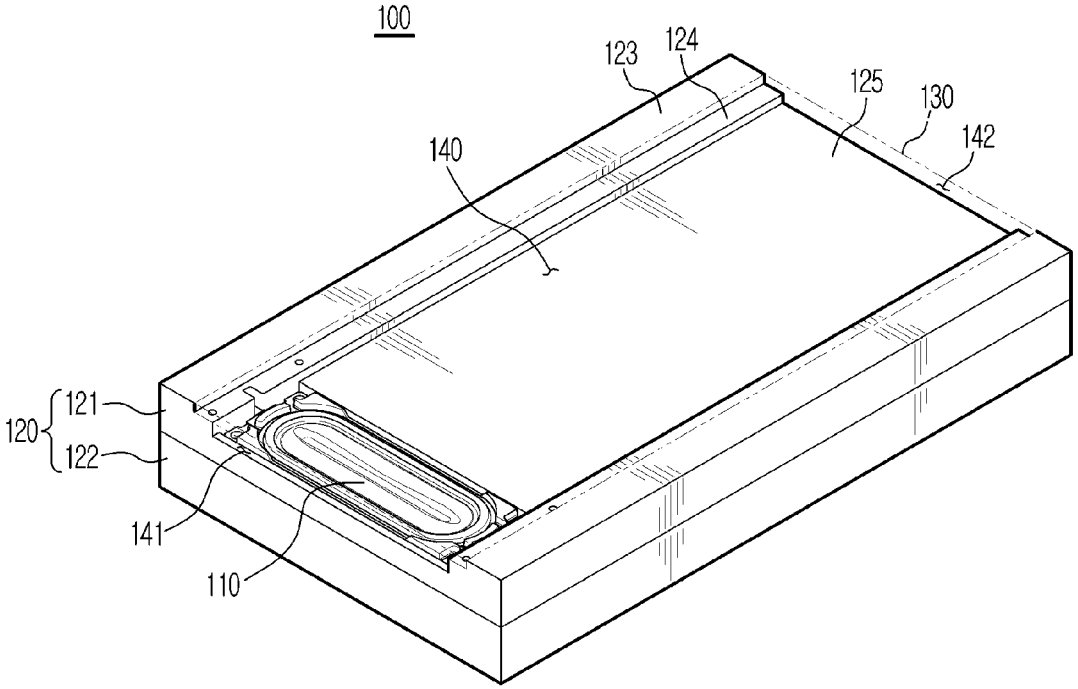
FIG. 3 is a perspective view of a speaker apparatus with a reflection plate represented as being transparent, according to an embodiment of the disclosure.
Figure 4:
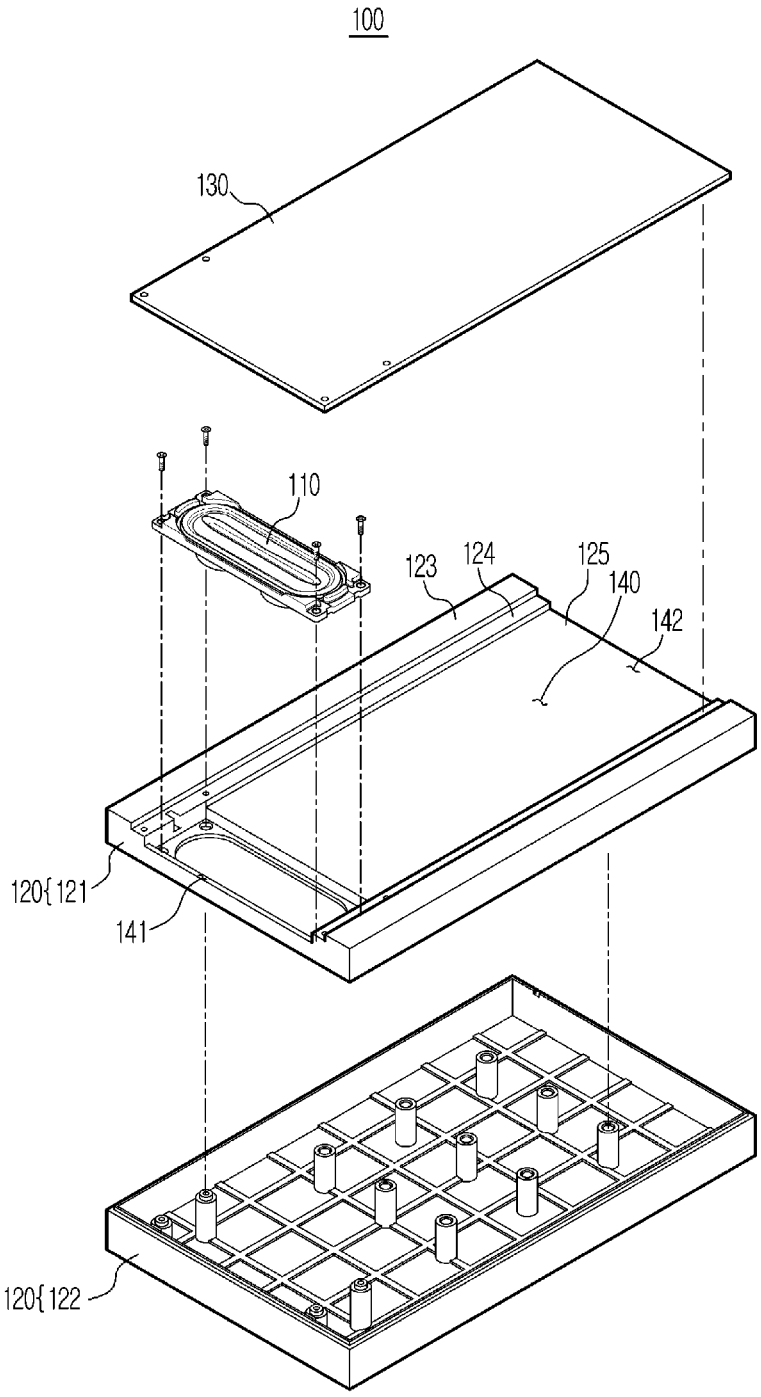
FIG. 4 is an exploded perspective view of the speaker apparatus shown in FIG. 3.

FIG. 3 is a perspective view of a speaker apparatus with a reflection plate represented as being transparent, according to an embodiment of the disclosure. FIG. 4 is an exploded perspective view of the speaker apparatus shown in FIG. 3.

As shown in FIG. 3, the speaker apparatus 100 may include a speaker unit 110 configured to generate sound, an enclosure 120 having the speaker unit 110 installed therein and blocking sound directed rearward of the speaker unit 110 so that the sound directed rearward is not mixed with sound directed forward, and a reflection plate 130 coupled to the enclosure 120 to cover the speaker unit 110.

The speaker unit 110 may be configured to generate sound. The speaker unit 110 may include a diaphragm and vibrate the diaphragm by reciprocating motion of a voice coil to generate sound.

The speaker unit 110 may be installed in the enclosure 120. Sound directed forward may be generated at a front surface of the speaker unit 110 and sound directed rearward may be generated at a rear surface of the speaker unit 110.

The enclosure 120 may block the sound directed rearward to prevent the forward sound and rearward sound, which are in antiphase, from being mixed with each other. The sound directed rearward are 180° out of phase with the sound directed forward. In other words, the enclosure 120 may prevent the sound directed forward and the sound directed rearward from being directly mixed without sound filtering.

The reflection plate 130 may be coupled to the enclosure 120 with the speaker unit 110 installed therein. The reflection plate 130 may be disposed to cover the front surface of the speaker unit 110. The reflection plate 130 may reflect the sound generated by the speaker unit 110.

The reflection plate 130 may be spaced apart from the speaker unit 110 by a predetermined distance. The reflection plate 130 may be disposed at a predetermined distance from the enclosure 120 as well. This is to form an acoustic path 140.

At both ends of the speaker apparatus 100, a radiating part 141 and an opening part 142 may be provided. Specifically, the radiating part 141 and the opening part 142 may be provided at both ends of the acoustic path 140. Both ends of the acoustic path 140 may be opened. The radiating part 141 may refer to an open end of the acoustic path 140. The opening part 142 may refer to the other open end of the acoustic path 140.

The radiating part 141 may be disposed to be adjacent to the speaker unit 110. The radiating part 141 may be provided as a slit-shaped opening whose lateral length is larger than the longitudinal length. The sound generated from the speaker unit 110 may be radiated to the outside of the speaker apparatus 100 through the radiating part 141. The sound radiated through the radiating part 141 may be transmitted to a user as a main reproduction sound of the speaker unit 110. When the speaker apparatus 100 is installed in an electronic device, the radiating part 141 may be disposed on at least one of the top, bottom, or both sides of the electronic device. A plurality of holes may be provided in front of the radiating part 141 according to design specifications of the electronic device.

The radiating part 141 may be disposed at one end of the speaker apparatus 100 and the opening part 142 may be disposed at the other end of the speaker apparatus 100.

In the speaker apparatus 100 according to an embodiment of the disclosure, the opening part 142 may have the same shape as the radiating part 141. The opening part 142 may be provided to face the radiating part 141.

A portion of the sound generated in the speaker unit 110 may be radiated through the opening part 142. With the opening part 142, the speaker apparatus 100 according to the disclosure may prevent occurrence of peaks and dips unlike the slit-firing speaker according to the related art. A detailed description thereof will be described later.

Hereinafter, a structure of the enclosure 120 will be described in detail.

The enclosure 120 may include an upper housing 121 and a lower housing 122 coupled with the upper housing 121 to form a space therein.

The upper housing 121 may include a blocking wall 123, a coupling portion 124, and a path portion 125.

The path portion 125 may form a lower surface of the acoustic path 140. The path portion 125 may be formed in a rectangular shape.

The coupling portion 124 may be provided at both ends of the path portion 125 and may protrude upward from the path portion 125. The reflection plate 130 may be coupled to the coupling portion 124.

The blocking walls 123 may be provided at both ends of the coupling portion 124 and protrude upward from the coupling portion 124. The reflection plate 130 may be disposed between a pair of blocking walls 123. A side surface of the blocking wall 123 and a side surface of the reflection plate 130 may be provided to be in contact with each other. A distance from the upper surface of the coupling portion 124 to the upper surface of the blocking wall 123 may be equal to the height of the reflection plate 130. Accordingly, the speaker apparatus 100 may be provided in a substantially rectangular parallelepiped shape.

Hereinafter, the acoustic path 140 will be described in detail.

Figure 5:
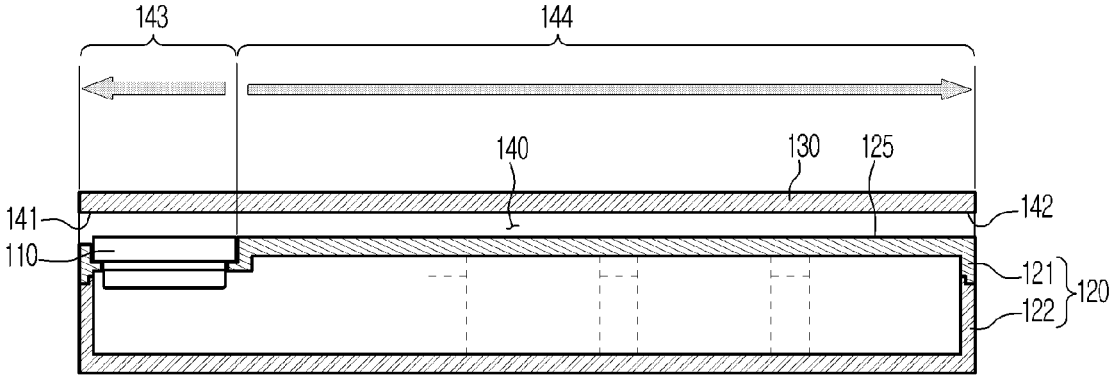
FIG. 5 is a side cross-sectional view of a speaker apparatus according to an embodiment of the disclosure.
Figure 6:
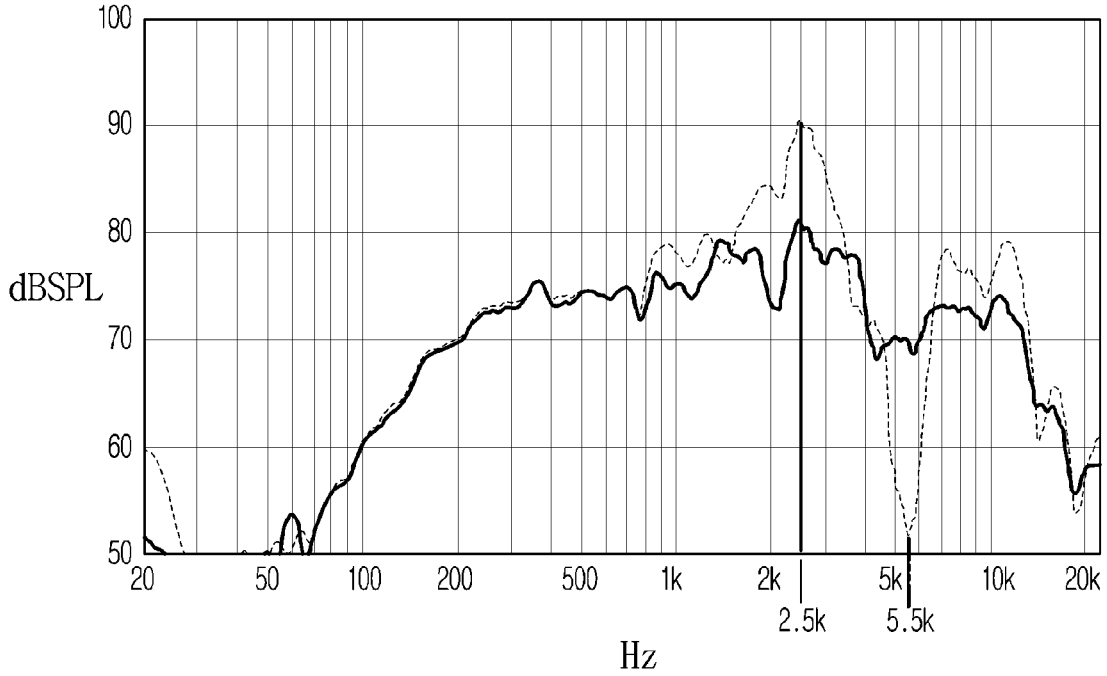
FIG. 6 is a graph showing intensities of acoustic signals according to frequencies in each of a speaker apparatus according to an embodiment and a slit-firing speaker apparatus according to the related art.

FIG. 5 is a side cross-sectional view of a speaker apparatus according to an embodiment of the disclosure. FIG. 6 is a graph showing intensities of acoustic signals according to frequencies in a speaker apparatus according to an embodiment and a slit-firing speaker apparatus according to the related art.

As shown in FIG. 5, the acoustic path 140 may include a radiation path 143 and a control path 144.

The radiation path 143 may extend from one end of the speaker unit 110 to the radiation part 141. The control path 144 may extend from one end of the speaker unit 110 to the opening part 142.

The radiation path 143 may radiate sound generated by the speaker unit 110 through the radiation part 141. If the radiation path 143 is long, a high frequency band loss may occur. Therefore, the speaker unit 110 may be disposed as close as possible to the radiation part 141 to minimize the length of the radiation path 143.

The radiation path 143 is provided to transmit the sound generated by the speaker unit 110 to a user. Most of the sound generated in the speaker unit 110 may be radiated to the radiation part 141 through the radiation path 143 because the reflection plate 130 reflects sound and the blocking wall 123 and the path portion 125 also reflect the sound without passing it.

The control path 144 may be provided to regulate resonance occurring inside the acoustic path 140. The opening part 142 may be provided at the end of the control path 144.

Figure 1:
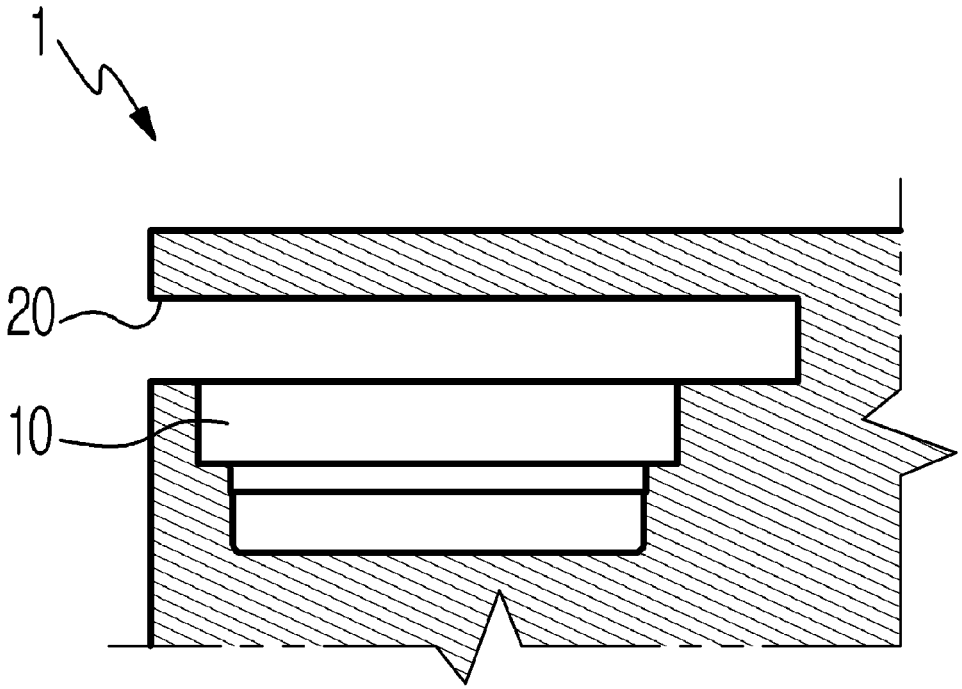
FIG. 1 is a cross-sectional view of a slit-firing speaker apparatus according to the related art.
Figure 2:
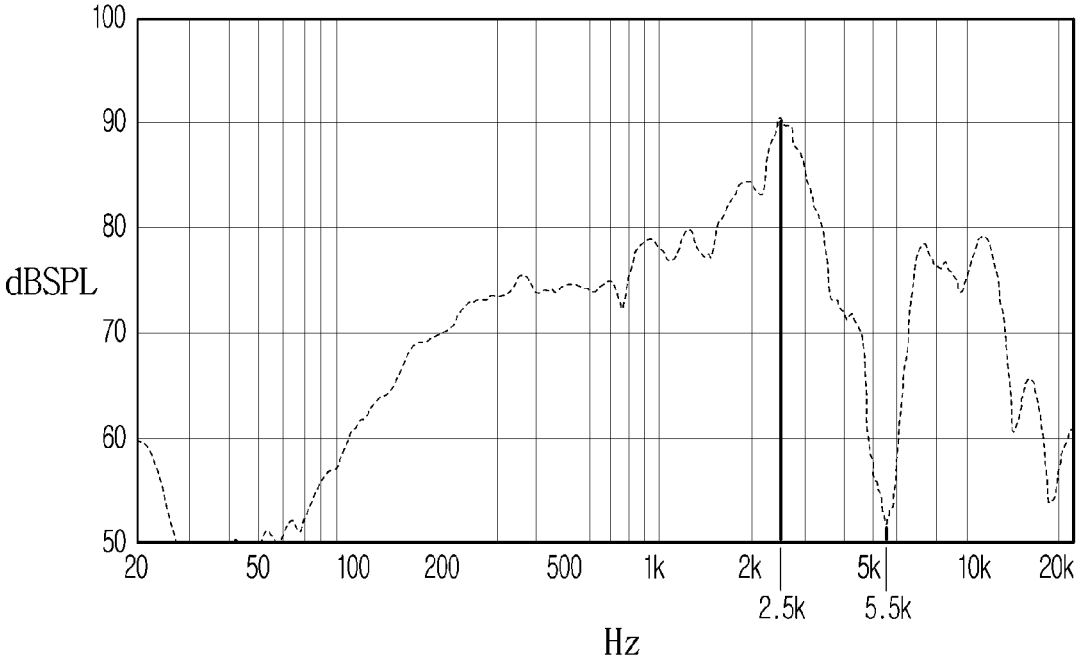
FIG. 2 is a graph showing an intensity of a sound signal at each frequency in a slit-firing speaker apparatus according to the related art.

In the slit-firing speaker according to the related art shown in FIG. 1, an end of the slit 20 is closed. The slit-firing speaker according to the related art has no control path, and thus resonance occurs at a specific frequency. There is a peak at the specific frequency, at which the output suddenly increases at the specific frequency due to the occurrence of resonance. The peak causes unbalance of energy, thereby leading to a dip. As described above, the peak may be compensated by signal processing, but the dip is not compensated by the signal processing, so a separate tweeter is required. This causes a rise in manufacturing cost of the electronic device including the slit-firing speaker.

According to an aspect of the disclosure, the acoustic path 140 may include the control path 144. The opening part 142 may be provided at an end of the control path 144. Since the opening part 142 is provided, an end of the acoustic path 140 is opened unlike the slit-firing speaker according to the related art. Sound may be radiated through the opening part 142, thereby preventing the dip phenomenon from occurring at a specific frequency. For example, a dip that would otherwise occur at 5.5 kHz does not occur.

However, if the control path 144 is too short, the occurrence of a dip may be prevented due to the opening part 142, but the peak may still be generated by being shifted. A dip may not occur in the audible range, but a peak may occur at other frequencies in the audible range. The control path 144 may be longer than twice the length of the radiation path 143 to prevent generation of both the dip and the peak in the audible range. Alternatively, the control path 144 may be longer than twice the width of the speaker unit 110. The width of the speaker unit refers to length of the speaker unit in a direction in which the acoustic path extends.

When the control path 144 is set to be two or more times longer than the radiation path 143, neither peak nor dip occurs in the audible range as shown in FIG. 6. The slit-firing speaker according to the disclosure prevents deterioration of sound quality and enables reproduction of middle and high frequency bands without a separate tweeter.

Figure 7:
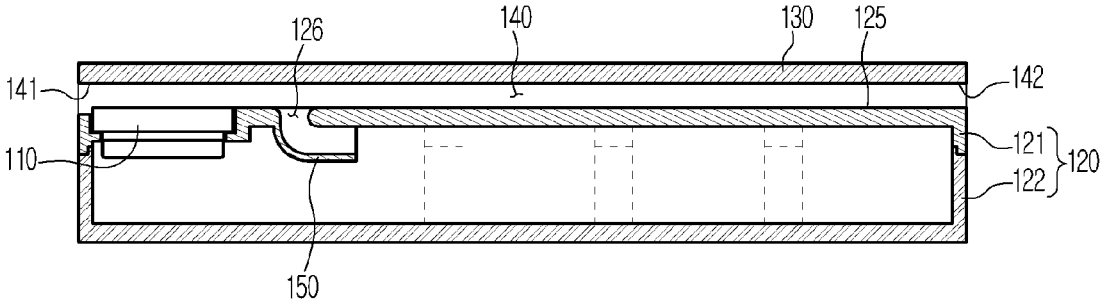
FIG. 7 is a side cross-sectional view of a speaker apparatus according to another embodiment of the disclosure.

FIG. 7 is a side cross-sectional view of a speaker apparatus according to another embodiment of the disclosure.

As shown in FIG. 7, a speaker apparatus according to another embodiment of the disclosure may include a duct 150.

The duct 150 may be provided to connect the inside of the enclosure 120 from a hole 126 formed in one surface of the enclosure 120.

The duct 150 may improve low frequency reproducibility of the speaker unit 110. The duct 150 may reinforce the low frequency band performance of the speaker unit 110.

The duct 150 may be provided at one side of the path portion 125. Specifically, the duct 150 may be provided on one surface of the enclosure 120 facing the reflection plate 130. In typical cases, a duct is exposed to the outside of the enclosure. However, since the duct 150 according to this embodiment of the disclosure is covered by the reflection plate 130, the duct 150 may not be exposed to the outside. On the other hand, since the duct 150 is disposed inside the acoustic path 140, it is desirable that the duct 150 is designed to be relatively short in consideration of damping.

Figure 8:
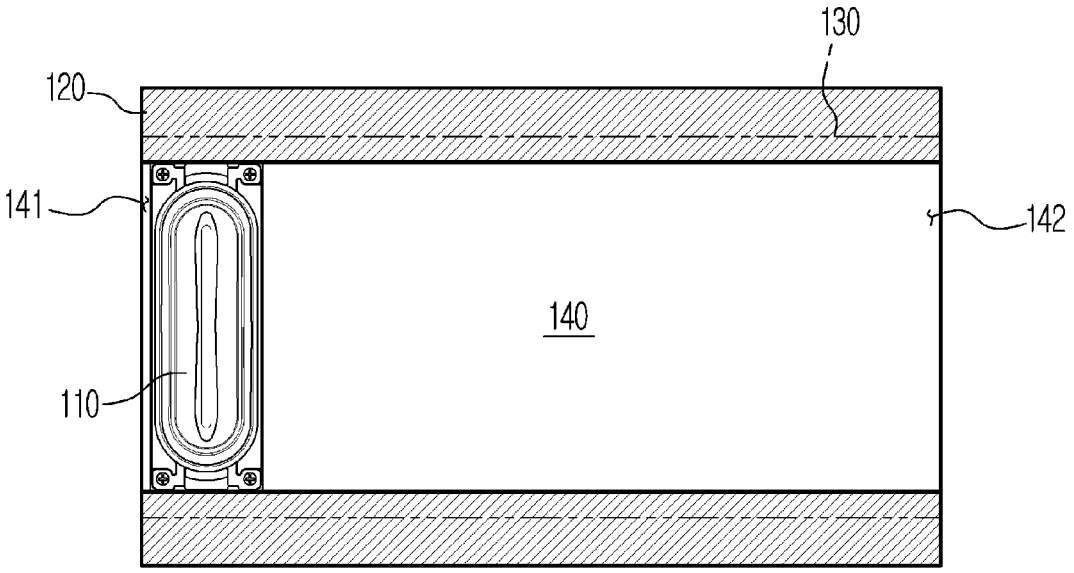
FIG. 8 is a plan view of the speaker apparatus shown in FIG. 3 with a reflection plate represented as being transparent.

FIG. 8 is a plan view of the speaker apparatus shown in FIG. 3 with a reflection plate represented as being transparent. FIGS. 9 to 12 are plan views of a speaker apparatus with a reflection plate represented as being transparent, according to another embodiment of disclosure.

As shown in FIGS. 8 to 12, according to an aspect of the disclosure, the acoustic path 140 may be provided in various shapes.

Figure 9:
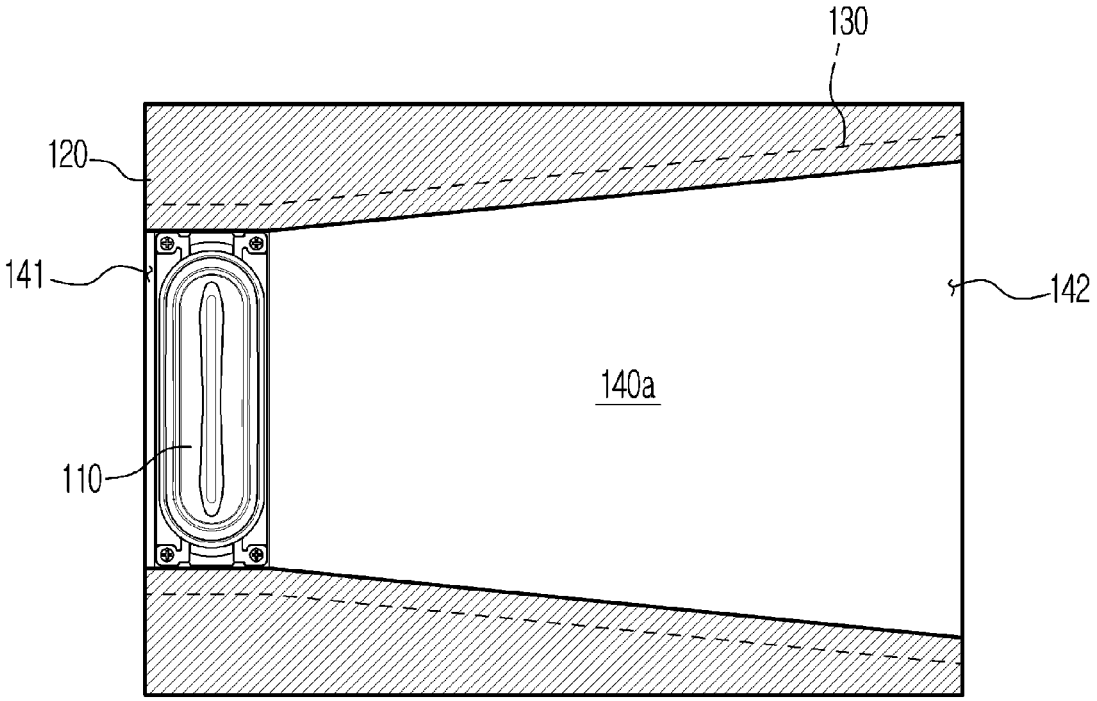
FIG. 9 is a plan view of a speaker apparatus with a reflection plate represented as being transparent, according to another embodiment of disclosure.
Figure 10:
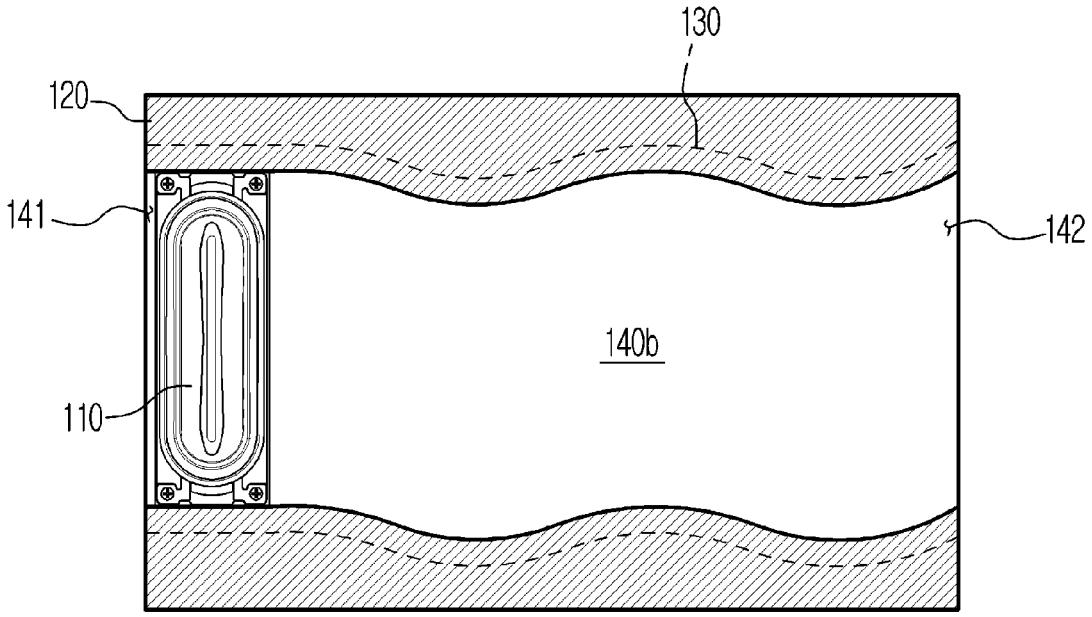
FIG. 10 is a plan view of a speaker apparatus with a reflection plate represented as being transparent, according to another embodiment of disclosure.
Figure 11:
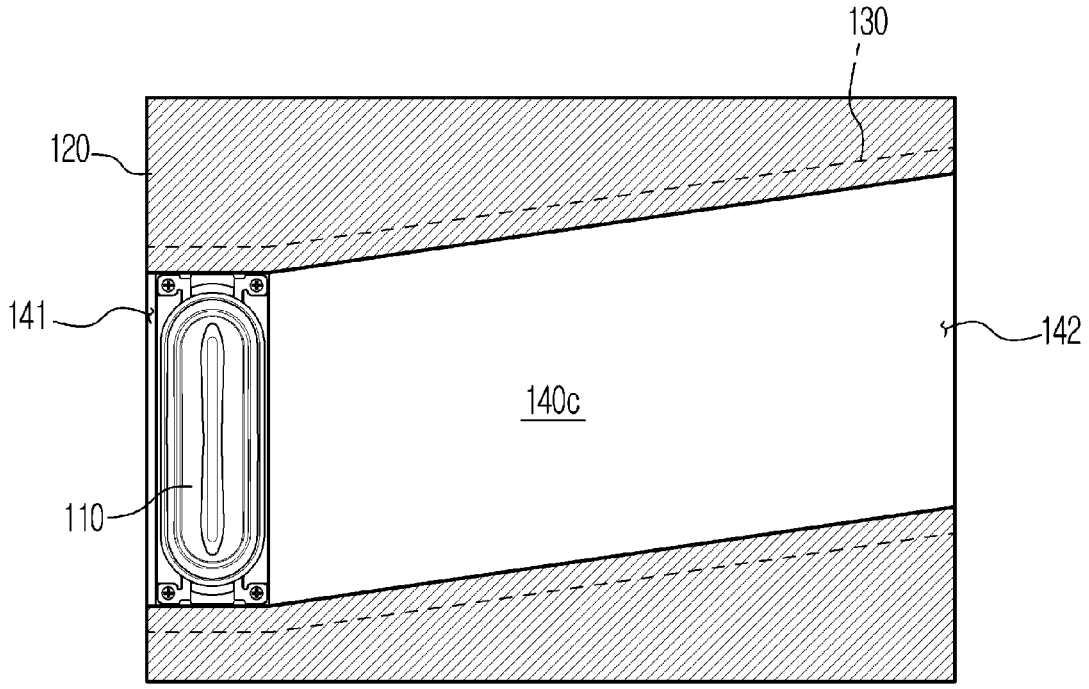
FIG. 11 is a plan view of a speaker apparatus with a reflection plate represented as being transparent, according to another embodiment of disclosure.
Figure 12:
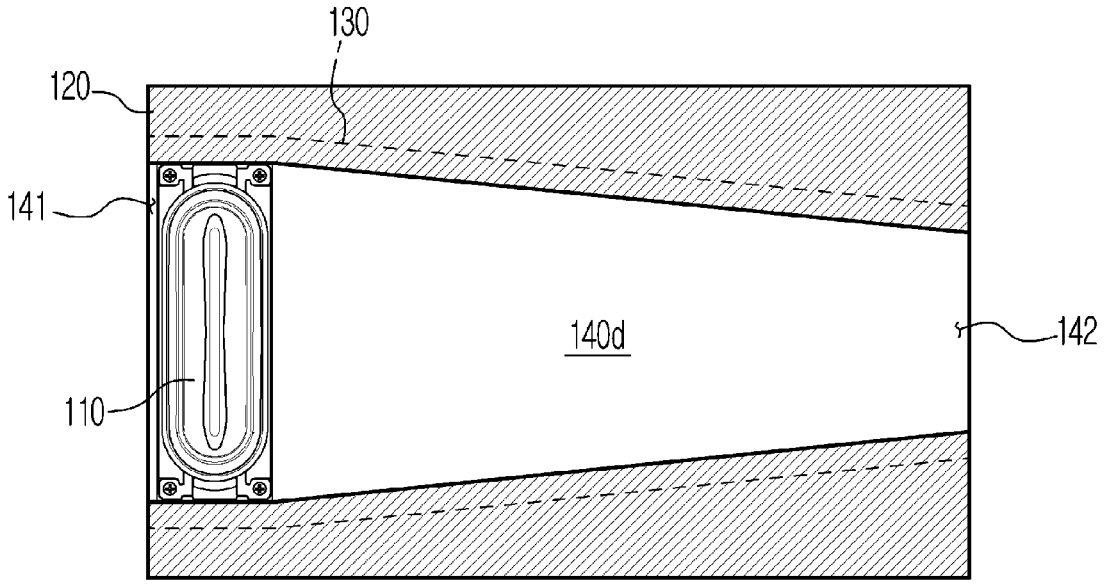
FIG. 12 is a plan view of a speaker apparatus with a reflection plate represented as being transparent, according to another embodiment of disclosure.

As shown in FIG. 8, the acoustic path 140 may be provided such that the width of the acoustic path 140 is constant all across the acoustic path 140 and the radiation part 141 and the opening part 142 are opposite to each other. Alternatively, as shown in FIG. 9, the acoustic path 140*a* may be provided such that the width of the control path 144 gradually increases as it goes toward the opening part 142. Conversely, as shown in FIG. 12, the width of the control path 144 may gradually decrease as it goes toward the opening part 142. As shown in FIG. 11, the control path 144 may be formed to be inclined to a direction. As shown in FIG. 10, the control path 144 may include a curved region. Thus, the acoustic characteristics of the speaker apparatus 100 may be controlled through the control path 144 of various shapes or structures. The various shapes of the control path 144 may make slight differences in acoustic performance, but the effect of preventing generation of peaks and dips in the audible range remains unchanged.

For example, in the case of the embodiment shown in FIG. 12, the acoustic path 140*d* may include a control path whose width gradually decreases as it goes toward the opening part 142 and a radiation path having a constant width. According to this structure, the acoustic energy emitted through the opening part 142 may be relatively small. The acoustic energy radiated through the control path may be extinguished inside the electronic device or may have less influence on the sound radiated through the radiation part 141.

Although not shown in the drawing, the reflection plate may be provided in a shape corresponding to the speaker unit in order to keep a distance between the speaker unit and the reflection plate constant. To this end, the reflection plate may be recessed in a region where the speaker unit protrudes toward the reflection plate. Conversely, in a region where the speaker unit protrudes toward the enclosure, the reflection plate may be provided to protrude. This may improve the acoustic performance in the high frequency band.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A speaker apparatus comprising:

a speaker unit configured to provide sound;

an enclosure, in which the speaker unit is installed, configured to block sound directed rearward to prevent sound directed forward and the sound directed rearward from being mixed; and a reflection plate configured to cover the speaker unit and coupled to the enclosure to form an acoustic path through which the provided sound travels;

wherein the acoustic path comprises:

a radiation part formed at an end of the acoustic path and radiating the provided sound; and an opening part formed at the other end of the acoustic path, and wherein the acoustic path comprises a radiation path configured to guide the provided sound to the outside of the speaker apparatus to allow a user to hear the provided sound, and a control path provided to regulate generation of resonance in the acoustic path, wherein an acoustic pressure of the sound radiated through the control path is less than an acoustic pressure of the sound radiated through the radiation path.

2. The speaker apparatus of claim 1, wherein the radiation part comprises a slit-shaped opening having lateral length longer than longitudinal length.

3. The speaker apparatus of claim 1, wherein the radiation path extends from the speaker unit to the radiation part, and the control path extends from the speaker unit to the opening part.

4. The speaker apparatus of claim 1, wherein length of the control path is formed to be at least twice the length of the radiation path.

5. The speaker apparatus of claim 1, wherein the control path has varying width from an end of the radiation path toward the opening part.

6. The speaker apparatus of claim 1, wherein the speaker unit is disposed at an end in a longitudinal direction of the enclosure to be adjacent to the radiation part.

7. The speaker apparatus of claim 1, wherein the reflection plate comprises a surface facing the speaker unit, and the surface is provided to correspond to the shape of the speaker unit so that a distance between the surface and the speaker unit is not changed.

8. The speaker apparatus of claim 1, wherein the acoustic path has constant width throughout the acoustic path.

9. The speaker apparatus of claim 1, wherein the acoustic path comprises a curved portion.

10. The speaker apparatus of claim 1, wherein the enclosure comprises a duct extending from a hole formed on a surface facing the reflection plate toward an inside of the enclosure.

11. The speaker apparatus of claim 1, wherein the acoustic path prevents leakage of the sound provided in the speaker unit so that the sound provided by the speaker unit is radiated through the radiation part.

* * * * *